US005261672A

United States Patent [19]

Jordan

[11] Patent Number: 5,261,672

[45] Date of Patent: Nov. 16, 1993

[54] METHOD OF PLAYING A TAX BOARD GAME

[76] Inventor: Carolyn M. Jordan, 131 Bruce St., Brady, Tex. 76825

[21] Appl. No.: 18,217

[22] Filed: Feb. 16, 1993

[51] Int. Cl.[5] ..... A63F 3/00

[52] U.S. Cl. ..... 273/256

[58] Field of Search ..... 273/256, 243, 249-254, 273/248

[56] References Cited

U.S. PATENT DOCUMENTS

| | | | |
|---|---|---|---|
| 4,440,397 | 4/1954 | Butner | 273/256 |
| 4,585,233 | 4/1986 | Wilson | 273/287 |
| 4,932,668 | 6/1990 | Stewart | 273/256 |

*Primary Examiner*—Benjamin H. Layno
*Attorney, Agent, or Firm*—Leon Gilden

[57] ABSTRACT

A game board having a single path to include an outer path and an inner path, whereupon the outer and inner paths include first through fourth spaces of respective monetary, penalty, and respective first and second coloration spaces, wherein the monetary spaces indicate expenses to be borne by an associated player, wherein penalty spaces are directed to a player losing a turn and the like, the first coloration spaces direct players to draw a card from a first card deck to provide that player with income, wherein the fourth spaces are of a second coloration and direct a player to draw cards from a second coloration deck for providing tax breaks to the individual at conclusion of the game to determine remaining income available to each player. The player having the most amount of available monetary funds is declared a winner.

2 Claims, 7 Drawing Sheets

TAX BRACKET

OTHER TAXES

METHOD OF PLAYING A TAX BOARD GAME

BACKGROUND OF THE INVENTION

1. Field of the Invention

The field of invention relates to game apparatus, and more particularly pertains to a new and improved tax board game apparatus wherein the same is directed to the simulation of income taxing relative to a life-like situation.

2. Description of the Prior Art

Game apparatus of various types have been indicated in the prior art with game apparatus directed to monetary themes indicated in U.S. Pat. Nos. 5,071,135 and 4,799,686. The U.S. Pat. No. 4,440,397 to be Butner sets forth a tax game having a single substantially serpentine path to associate various penalties and rewards along the path.

The instant invention attempts to overcome deficiencies of the prior art by providing for the award and penalties in association with further card draws from associated card decks relative to individual spaces of an inner and outer path of spaces and in this respect, the present invention substantially fulfills this need.

SUMMARY OF THE INVENTION

In view of the foregoing disadvantages inherent in the known types of game apparatus now present in the prior art, the present invention provides a tax board game apparatus wherein the same is directed to the accumulation of funds relative to penalty and award spaces throughout the game board. As such, the general purpose of the present invention, which will be described subsequently in greater detail, is to provide a new and improved tax board game apparatus which has all the advantages of the prior art game apparatus and none of the disadvantages.

To attain this, the present invention provides a game board having a single path to include an outer path and an inner path, whereupon the outer and inner paths include first through fourth spaces of respective monetary, penalty, and respective first and second coloration spaces, wherein the monetary spaces indicate expenses to be borne by an associated player, wherein penalty spaces are directed to a player losing a turn and the like, the first coloration spaces direct players to draw a card from a first card deck to provide that player with income, wherein the fourth spaces are of a second coloration and direct a player to draw cards from a second coloration deck for providing tax breaks to the individual at conclusions of the game to determine remaining income available to each player. The player having the most amount of available monetary funds is declared a winner.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tax board game apparatus which has all the advantages of the prior art game apparatus and none of the disadvantages.

It is another object of the present invention to provide a new and improved tax board game apparatus which may be easily and efficiently manufactured and marketed.

It is a further object of the present invention to provide a new and improved tax board game apparatus which is of a durable and reliable construction.

An even further object of the present invention is to provide a new and improved tax board game apparatus which is susceptible of a low cost of manufacture with regard to both materials and labor, and which accordingly is then susceptible of low prices of sale to the consuming public, thereby making such tax board game apparatus economically available to the buying public.

Still yet another object of the present invention is to provide a new and improved tax board game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
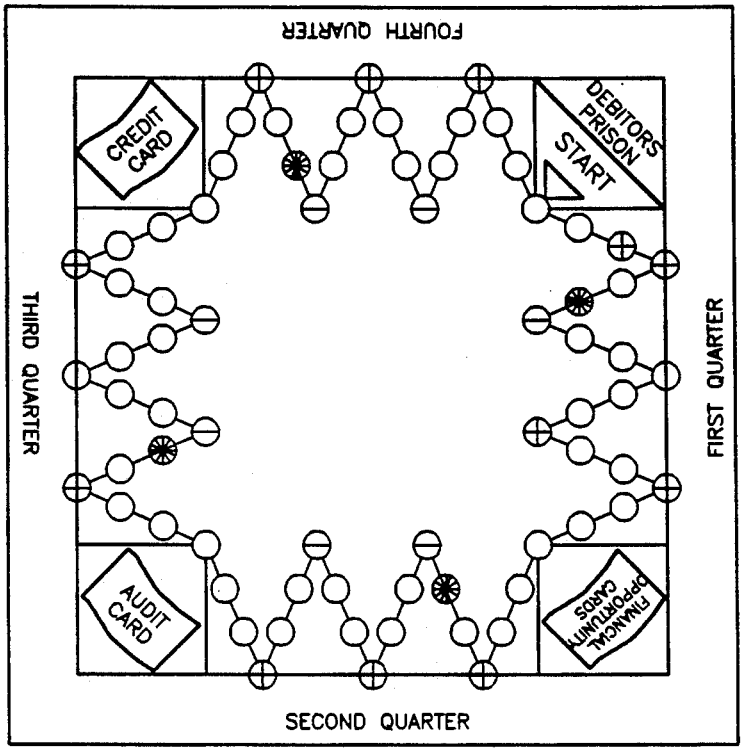
FIG. 1 PRIOR ART
FIG. 1 is an orthographic view of a prior art game structure as indicated in the U.S. Pat. No. 4,440,397.
Figure 2:
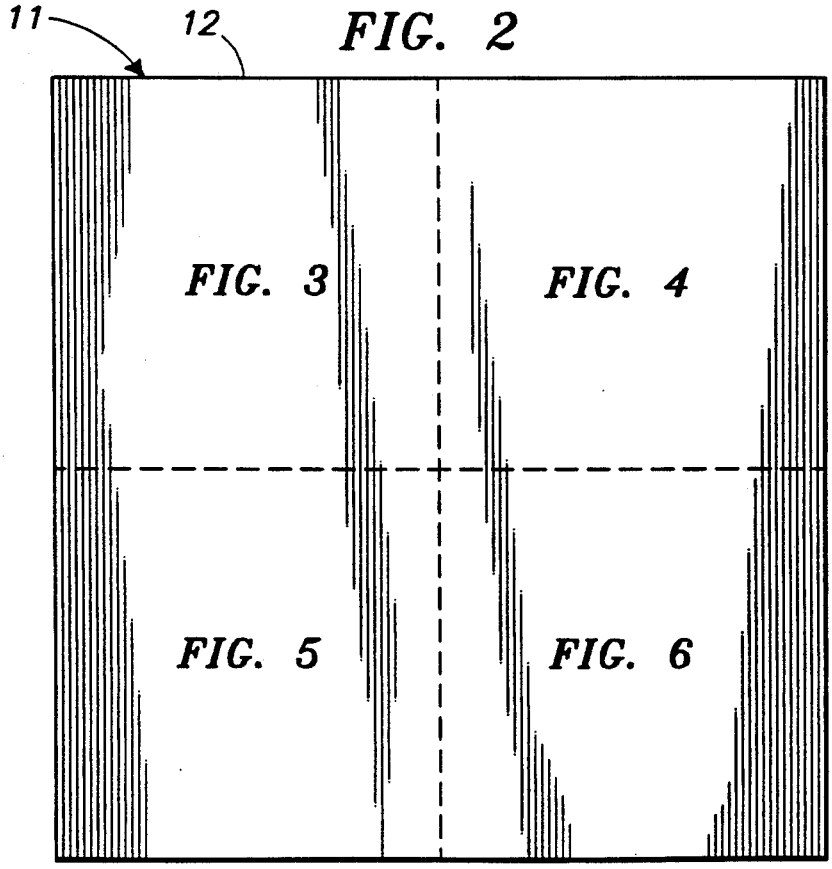
FIG. 2 is an orthographic schematic view of the game board of the invention.
Figure 3:
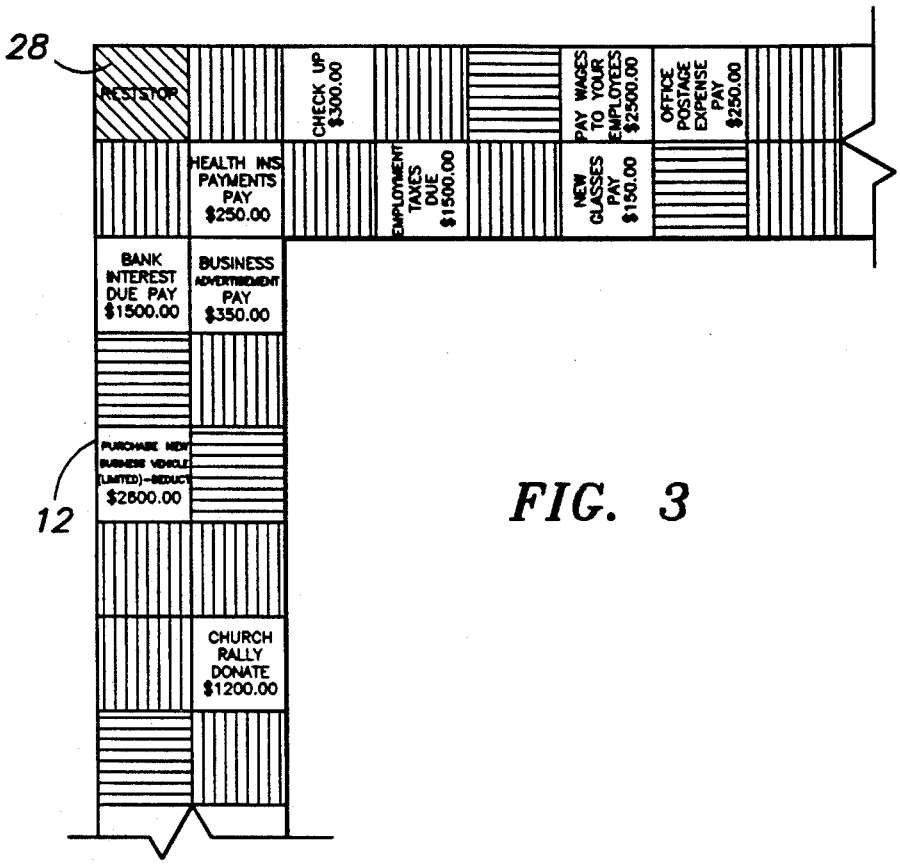
FIG. 3 is an enlarged orthographic view of section 3 of FIG. 2.
Figure 4:
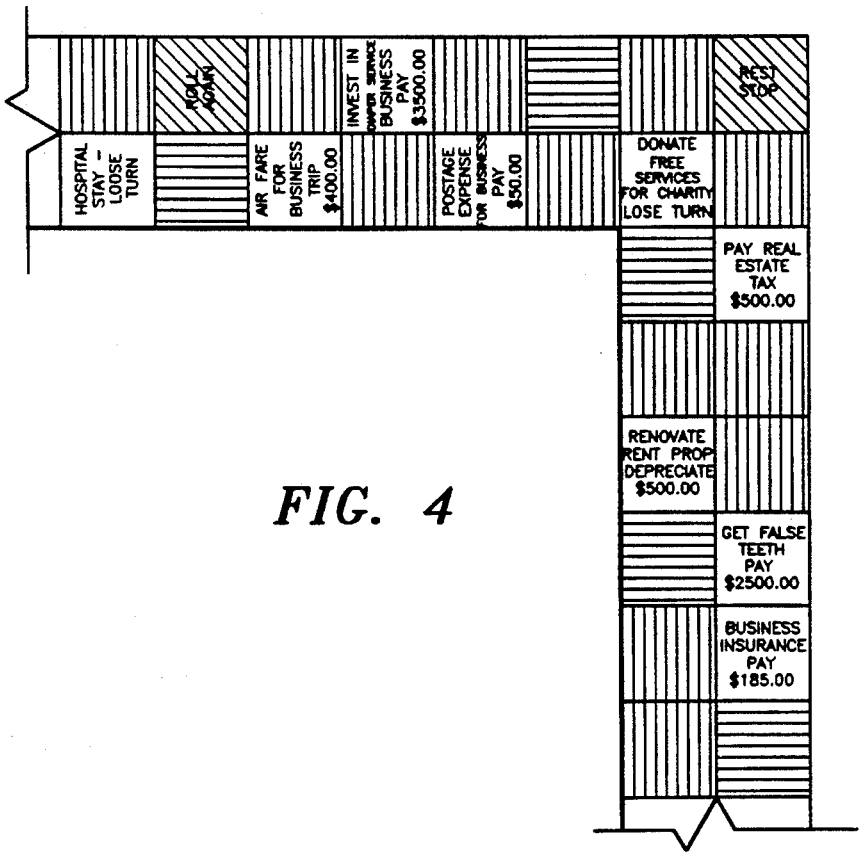
FIG. 4 is an enlarged orthographic view of section 4 as set forth in FIG. 2.
Figure 5:
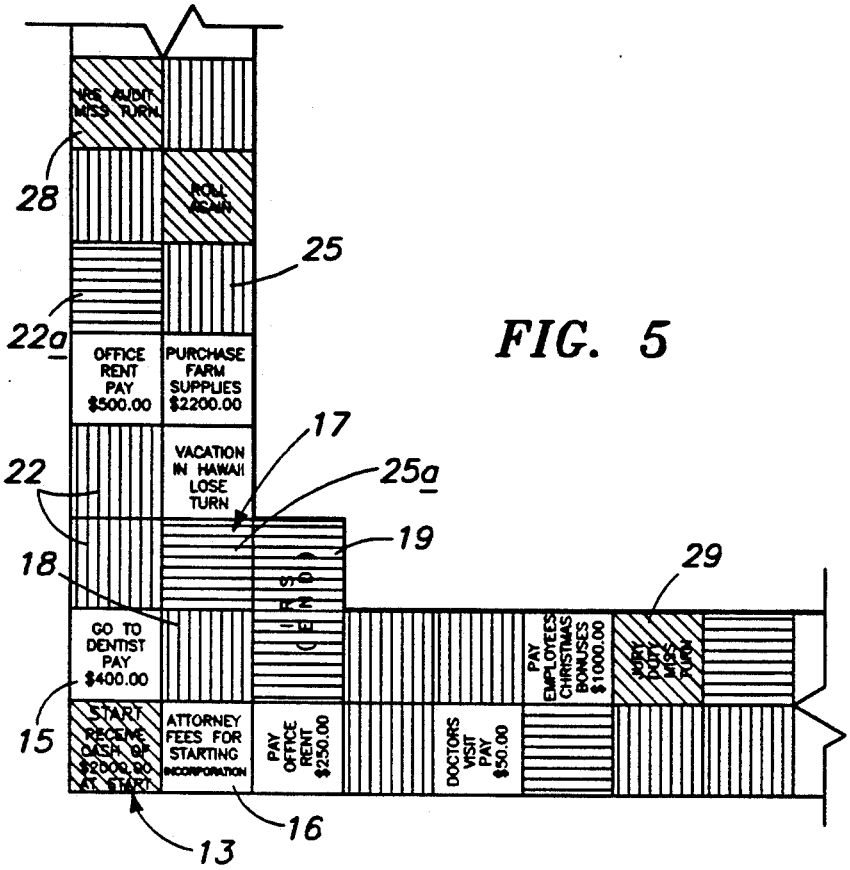
FIG. 5 is an enlarged orthographic view of section 5 as set forth in FIG. 2.
Figure 6:
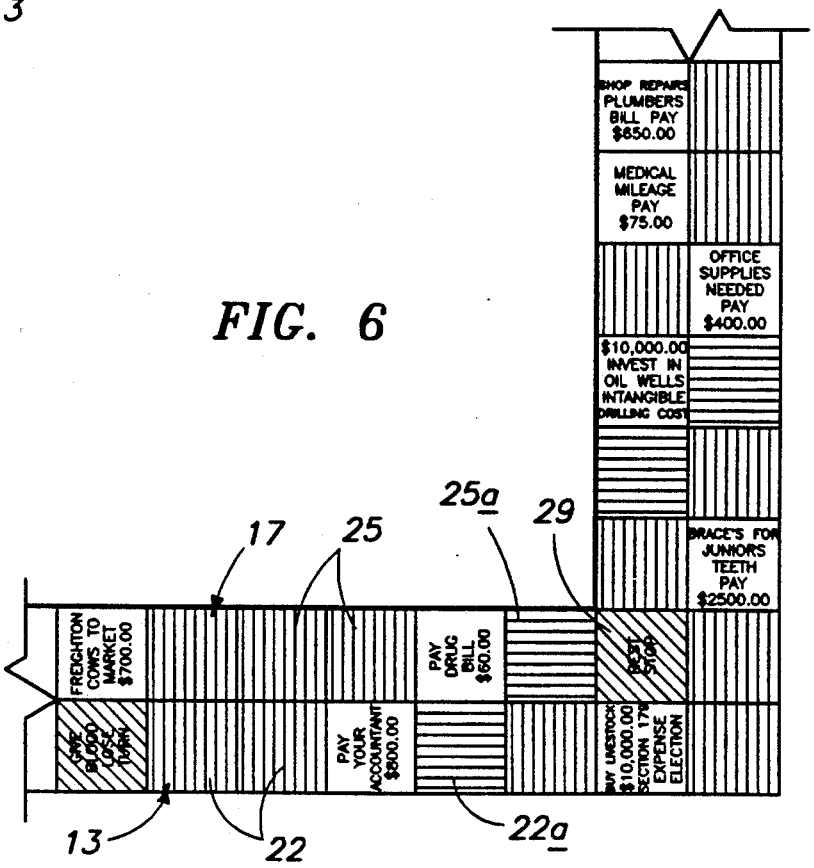
FIG. 6 is an enlarged orthographic view of section 6 as set forth in FIG. 2.
Figure 7:
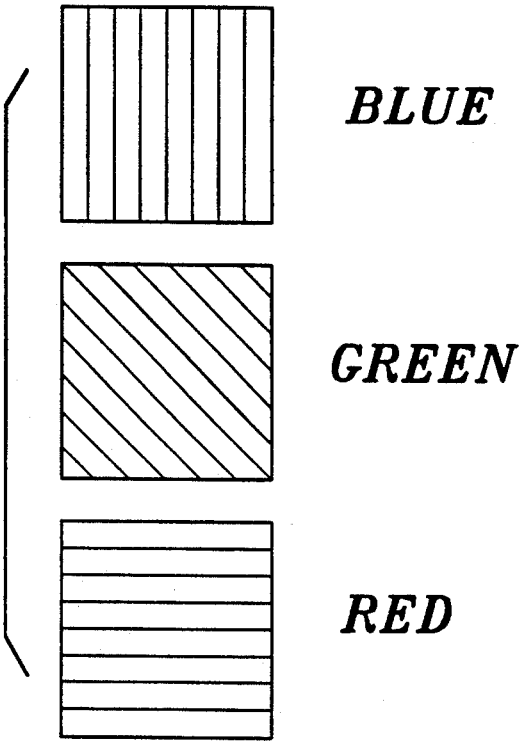
FIG. 7 is an orthographic view of the game coloration codes employed by the invention.
Figure 8:
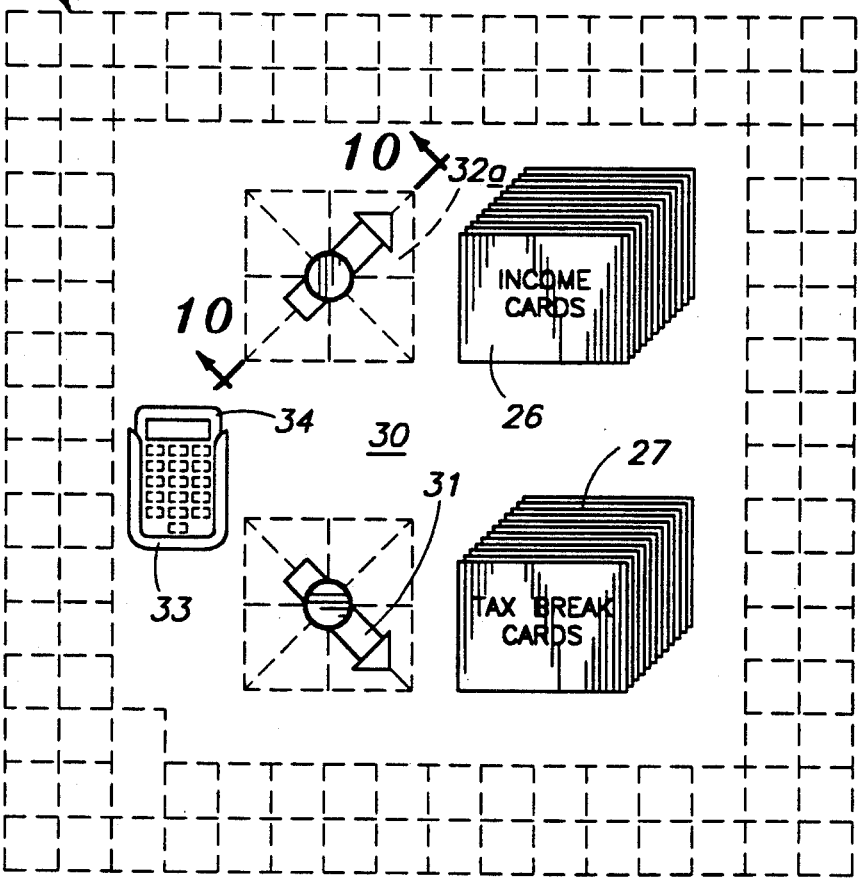
FIG. 8 is an orthographic view of the game board having indicated thereon the various components relative to the central space of the game board.
Figure 9:
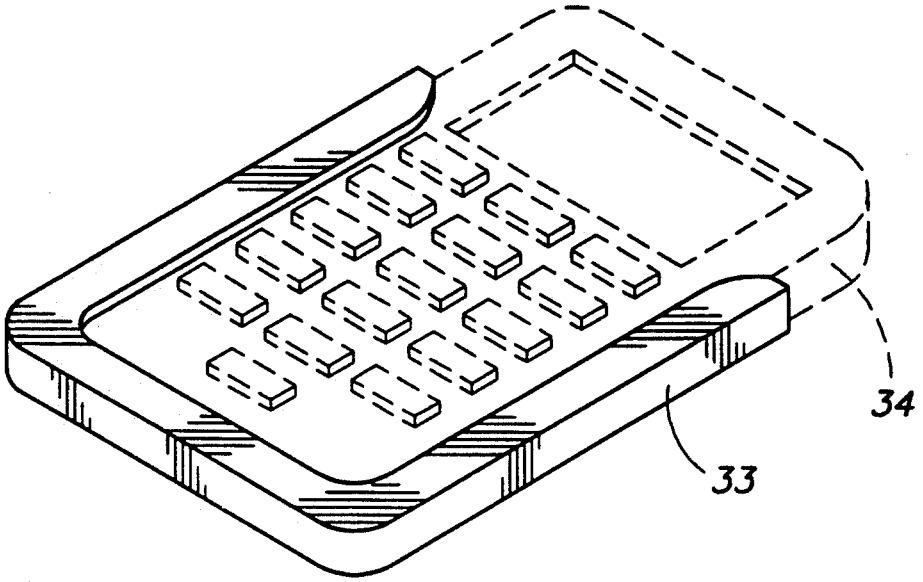
FIG. 9 is an enlarged isometric illustration of the calculator and support.
Figure 10:
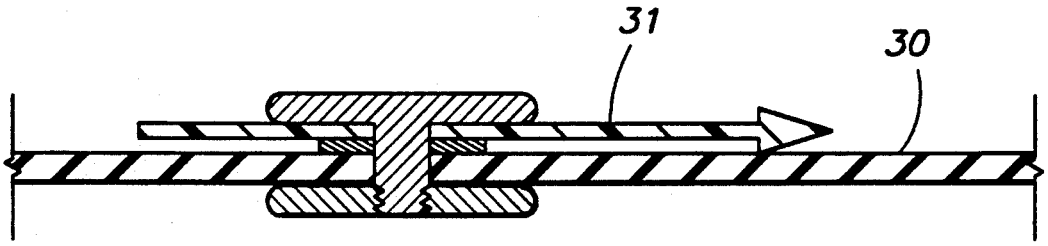
FIG. 10 is an enlarged orthographic view, taken along the lines 10—10 of FIG. 8 in the direction indicated by the arrows.

With reference now to the drawings, and in particular to FIGS. 1 to 14 thereof, a new and improved tax board game apparatus embodying the principles and concepts of the present invention and generally designated by the reference numerals 11-34 will be described.

More specifically, the tax board game apparatus of the invention essentially comprises a game board 11 having an outer periphery 12, with an outer continuous path 13 (see FIG. 5 for example) including a plurality of outer path spaces to include a start space 14. The outer path 13 includes path initial space 15 adjacent the start space 14 terminating in an outer path terminal space 16. An inner continuous path 17 is provided on the game board 11 in adjacency in contiguous communication to the outer path 15, with the inner path 17 having an inner path first space 18 in adjacency to the outer path initial internal spaces 15 and 16 respectively, with the inner path terminating in an inner path terminal space 19 indicating culmination of the game by each of the players. The inner path 17 is also provided with sequential inner path spaces as indicated.

The outer path 13 includes outer path first spaces 20 to indicate monetary expense deductions, with outer path second spaces 21 indicating penalty spaces such as lose of turn and the like. The outer path 13 further includes outer path third and fourth spaces 22 and 22*a* respectively of respective first and second colorations. Upon a player landing upon one of the third or fourth spaces 22 or 22*a*, that player selects a card from the first and second card stacks 26 and 27 of the respective first and second colorations respectively. The first card stack 26 are income cards, while the second card stack 27 includes tax break cards. In this manner, the income cards direct players to receive income, while the tax break cards are saved by the individual players for employment at termination of the game in assisting that individual player to total that player's tax liability. Examples of income cards:

Land sales, you receive $15,000
Jury duty, you receive $10
Loss of sale of stock, you pay $250
Incentive card, receive $2400
Farmers have drought, you sell livestock and receive $25,000
Receive crop fail insurance, $1900 and go forward two spaces
Salary, $15000
Salary, yoy receive additional $2000
Land lease income, you receive $8000
Business booming, you receive $20000 profit
New invention, you receive $100000
Sell wheat crop, you receive $40000

Examples of tax break cards are as follows:

Estimated tax payment, hold until end of game $1500 Subtract from tax total due
Earned income credit, $250, hold until end of game
Penalty underpaid one-quarter, $50 pay in addition to tax and hold until end of game
Free turn, replace card when you use, your free turn card can be used at the end of the game
Exemptions, have a baby, hold until end of game $2000 deduction
IRA contribution, $2000
Life Insurance proceeds, $10000, do not collect until game after taxes are paid
Tax audit regarding child care, $250, deduct from tax due
Federal income tax withheld, hold until end of game $500 deduct from total taxes due.

Further, the inner path 17 includes inner path first spaces 23 to indicate monetary expenses for use as deductions relative to play of the game and inner path second spaces 24 of penalty spaces such as loss of turn and the like. Inner path third and fourth spaces 25 and 25*a* are similar to the outer path third and fourth spaces 22 and 22*a*, wherein the inner path third and fourth spaces 25 and 25*a* direct players to select cards from the first and second card stacks 26 and 27 respectively, in a manner as indicated above.

The game employs a game board potential space 30, having a rotary spinner 31 or alternatively or in addition, dice members may be used. The rotary spinner 31 is rotatably mounted about an axle shaft that is fixedly mounted in an orthogonal relationship relative to a game board central space 30. An indicia array 32 oriented annularly about the rotary spinner 31 indicates the number of spaces to be directed forwardly by each individual player. It should be noted that tokens of various types may be employed or alternatively, coins may be employed as tokens relative to each player to indicate positioning of each player along the inner and outer paths 17 and 13 respectively.

A U-shaped calculator mount 33 is provided to secure a calculator 34 therewithin. The calculator mount 33 includes an L-shaped wall fixedly mounted to the central space 30 to define a pocket to secure in a frictional relationship the calculator 34 positioned within that pocket.

Figure 11:
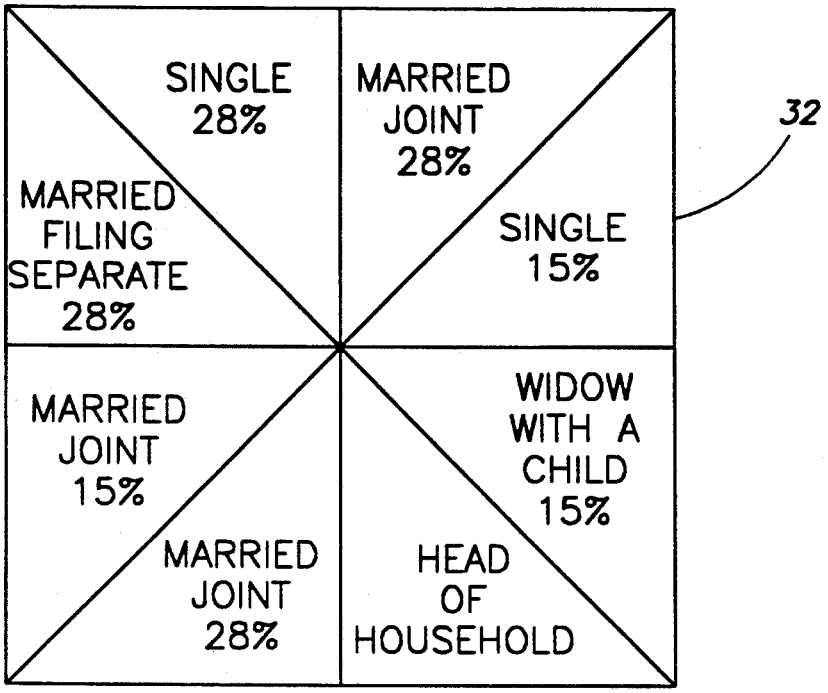
FIG. 11 is an orthographic view of a tax bracket directional card employed by the invention.
Figure 12:
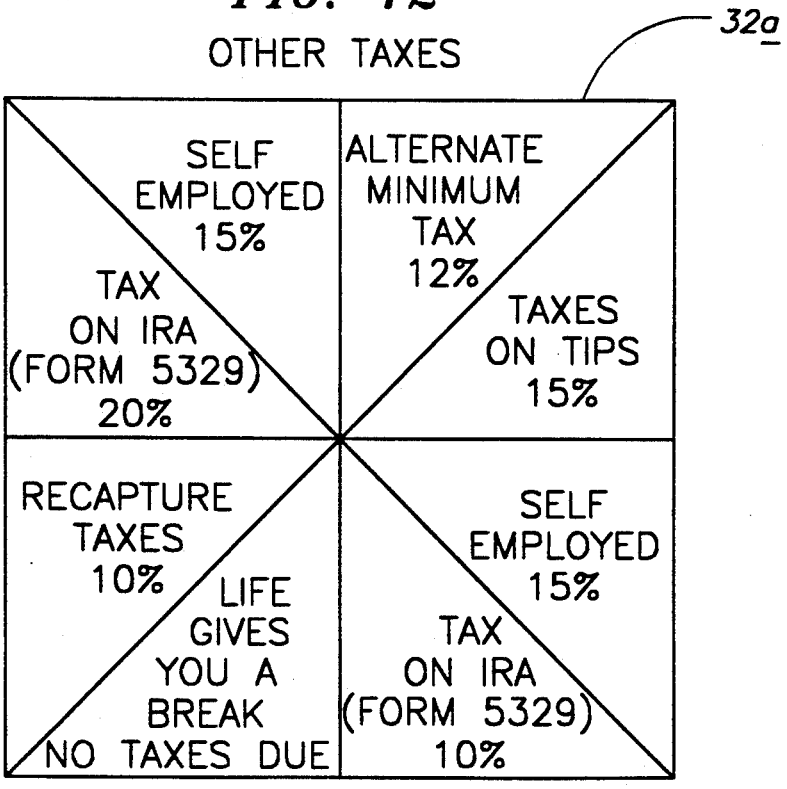
FIG. 12 is an orthographic view of a further tax card instructional member employed by the invention.
Figure 13:
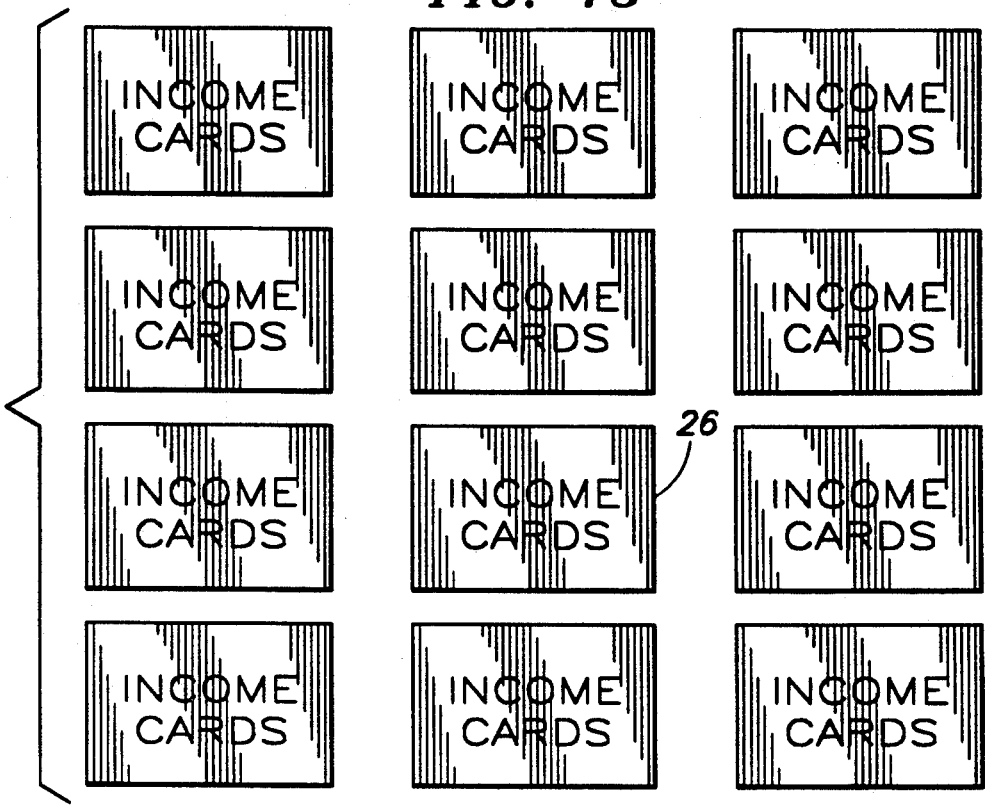
FIGS. 13 and 14 are orthographic views of the first and second card decks employed by the invention.
Figure 14:
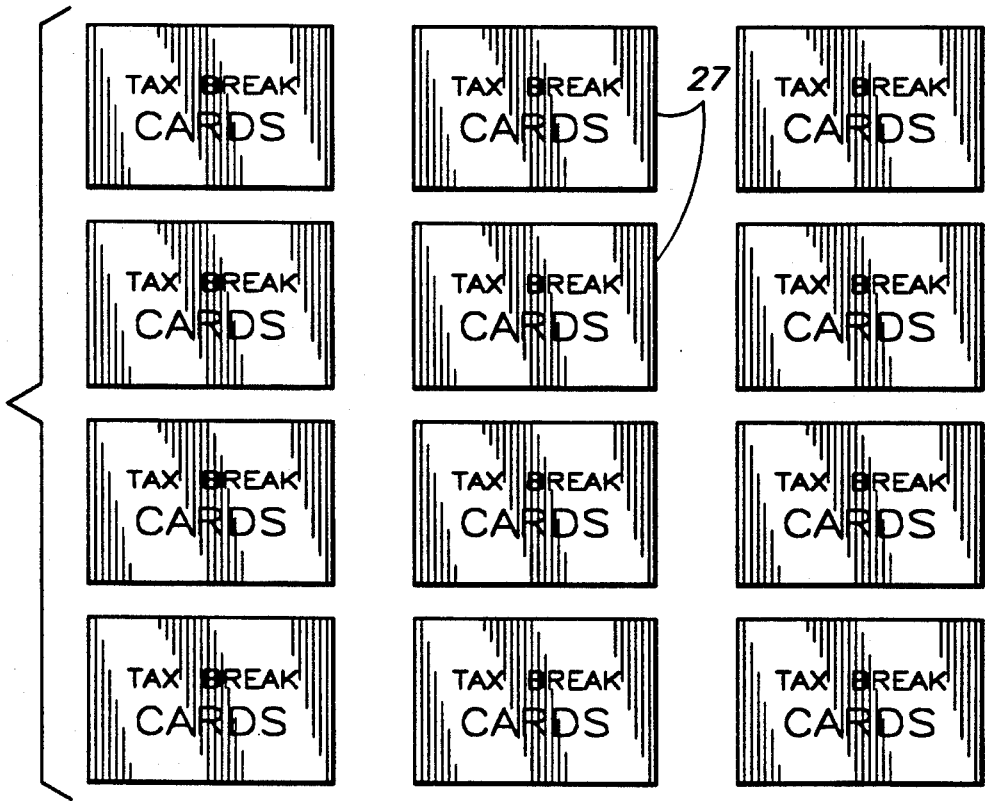

Rotary spinners 31 and 31*a* are provided having first and second annular arrays 32 and 32*a*. The annular arrays 32 and 32*a* each employ various segments to indicate the taxes to afforded and paid by each player. In spinning of the first spinner 31, the "tax bracket" relative to the indication of FIG. 11 is indicated for each player to provide that player with a percentage to be paid by that player of the player's remaining cash or money total subsequent to the receiving of money through the first cards of the first card stack 26. The player, as well as each individual player, spins the second spinner 31*a*, wherein the second annular array provides for indication of a second tax to be paid by each player in addition to the first tax of the first array. As indicated above, dice members of conventional construction are employed to direct and proceed players along the game board. Such dice members are of conventional construction and configuration as cube shaped geometric members having one through six indicated on the various six faces of the cube.

Subsequent to payment of taxes by the players, and the second cards of the second stack to limit payment, the player with the greatest monetary total resulting from play is declared a winner.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A method of playing a tax board game apparatus, comprising the steps of, providing playing pieces one for each player, providing a chance device, providing play money, providing a game board, the game board having an outer periphery, with an outer continuous path directed continuously about the outer periphery, and providing an inner continuous path positioned in adjacency to the outer path, the outer path having an outer path start space, and an outer path initial space, and an outer path terminal space, wherein the outer path including the outer path initial space, the outer path terminal space, and outer path spaces between the outer path initial space and the outer path terminal space including outer path first spaces to indicate monetary expenses for each player, outer path second spaces to indicate penalty spaces relative to each player, outer path third spaces directed in association with a first card stack and an outer path fourth space directed in association with the second card stack, the inner path including inner path first spaces to indicate monetary expense, inner path second spaces to indicate penalty spaces, inner path third spaces directed to the first card stack and inner path fourth spaces directed to the second card stack, the first card stack including first cards to indicate income accumulation relative to each player, the second card stack including second cards to indicate tax deduction indications relative to each player, with the second cards of the second card stack to be employed at each player landing upon the inner path terminal space, providing a central space within the inner path, providing a first rotary spinner and a second rotary spinner, with the first rotary spinner including an first annular array of first directions about the first spinner, and the second spinner including a second annular array of second directions about the second spinner, each first direction indicating a percentage wherein there are at least two different percentages on the first spinner, each second direction indicating a percentage wherein there are at least two different percentages in the second spinner, distributing a predetermined amount of play money equally to the players, placing the playing pieces on the start space, each player taking turns operating the chance device and moving their corresponding playing pieces along the outer continuous path then along the inner continuous path, each player, upon landing their playing piece on one of the first or second spaces, paying out or receiving play money according to the directions on the first or second spaces landed on, or upon landing their playing piece on one of the third or fourth spaces paying out or receiving money according to the directions on the corresponding first or second cards drawn, each player, upon landing on the terminal space, spinning the first spinner wherein the indicated percentage resulting from the spin is a first tax the player must pay out which is the percentage of that player's remaining cash or play money total subsequent to the receiving of money through the first cards, paying out the first tax, each player, upon landing on the terminal space, also spinning the second spinner wherein the indicated percentage resulting from the spin is a second tax the player must pay out which is the percentage of that player's remaining cash or play money total subsequent to the receiving of money through the first cards, paying out the second tax, subsequent to all the players' playing pieces landing on the terminal space, the paying of all the taxes, utilizing the second cards to limit payment, the player with the greatest monetary total being declared the winner.

2. A method of playing a board game as set forth in claim 1 providing a U-shaped calculator mount having an L-shaped wall of cross-sectional configuration to define a pocket to secure an associated calculator therewithin.

* * * * *